US008522477B2

(12) United States Patent
Bürgin et al.

(10) Patent No.: US 8,522,477 B2
(45) Date of Patent: Sep. 3, 2013

(54) ROTARY LOCK COMPRISING A LOCKING ARM THAT CAN BE PIVOTED PARALLEL TO THE MAIN ROTARY AXIS

(75) Inventors: Thomas Bürgin, Lörrach (DE); Gotthard Liehr, Schopfheim (DE)

(73) Assignee: Magnetic Autocontrol, GmbH, Schopfheim (DE)

( * ) Notice: Subject to any disclaimer, the term of this patent is extended or adjusted under 35 U.S.C. 154(b) by 574 days.

(21) Appl. No.: 11/990,361

(22) PCT Filed: Aug. 10, 2006

(86) PCT No.: PCT/DE2006/001395

§ 371 (c)(1),
(2), (4) Date: Feb. 4, 2009

(87) PCT Pub. No.: WO2007/019824

PCT Pub. Date: Feb. 22, 2007

(65) Prior Publication Data

US 2009/0307976 A1 Dec. 17, 2009

(30) Foreign Application Priority Data

Aug. 11, 2005 (DE) ..... 20 2005 012 659 U

(51) Int. Cl.
*E06B 11/08* (2006.01)

(52) U.S. Cl.
USPC ..... 49/47; 49/46; 49/42; 49/44

(58) Field of Classification Search
USPC ..... 49/42–47
See application file for complete search history.

(56) References Cited

U.S. PATENT DOCUMENTS 1,617,918 A * 2/1927 McLoughlin ..... 49/47
2,504,535 A * 4/1950 Kilpatrick ..... 49/47

(Continued)

FOREIGN PATENT DOCUMENTS

DE 6937378 1/1970
DE 2825787 12/1979

(Continued)

*Primary Examiner* — Katherine Mitchell
*Assistant Examiner* — Marcus Menezes
(74) *Attorney, Agent, or Firm* — Horst M. Kasper

(57) ABSTRACT

The invention relates to a rotary lock which is used to control the passage of people and comprises a locking unit that can be blocked and unblocked, can be rotated about an inclined rotational axis, and comprises preferably three blocking arms (2) which can successively, in progressive steps, be brought from a position blocking the passage of a person into a position freeing the passage of a person. In the event of a breakdown or danger, the unhindered passage of any number of people is enabled by locking a respective blocking arm (2) on a bearing plate (4) carrying the blocking arms (2) in an articulated manner (4), by means of a locking element (7) engaging in an opening (8). In the event of a breakdown, the locking element (7) of the blocking arm (2) located in the blocking position is mechanically released from the engagement in the opening (8), and an eccentric force applied to the blocking arm (2) pivots the same out of the normal position thereof into the release position thereof. When the breakdown is over, the blocking arm (2) in question is temporarily blocked and automatically brought back into the normal position thereof by rotating the bearing plate (4) by less than a progressive step, as a result of the forced rotation thereof in relation to the bearing plate (4).

17 Claims, 9 Drawing Sheets

(56) References Cited

U.S. PATENT DOCUMENTS

Figure 1:
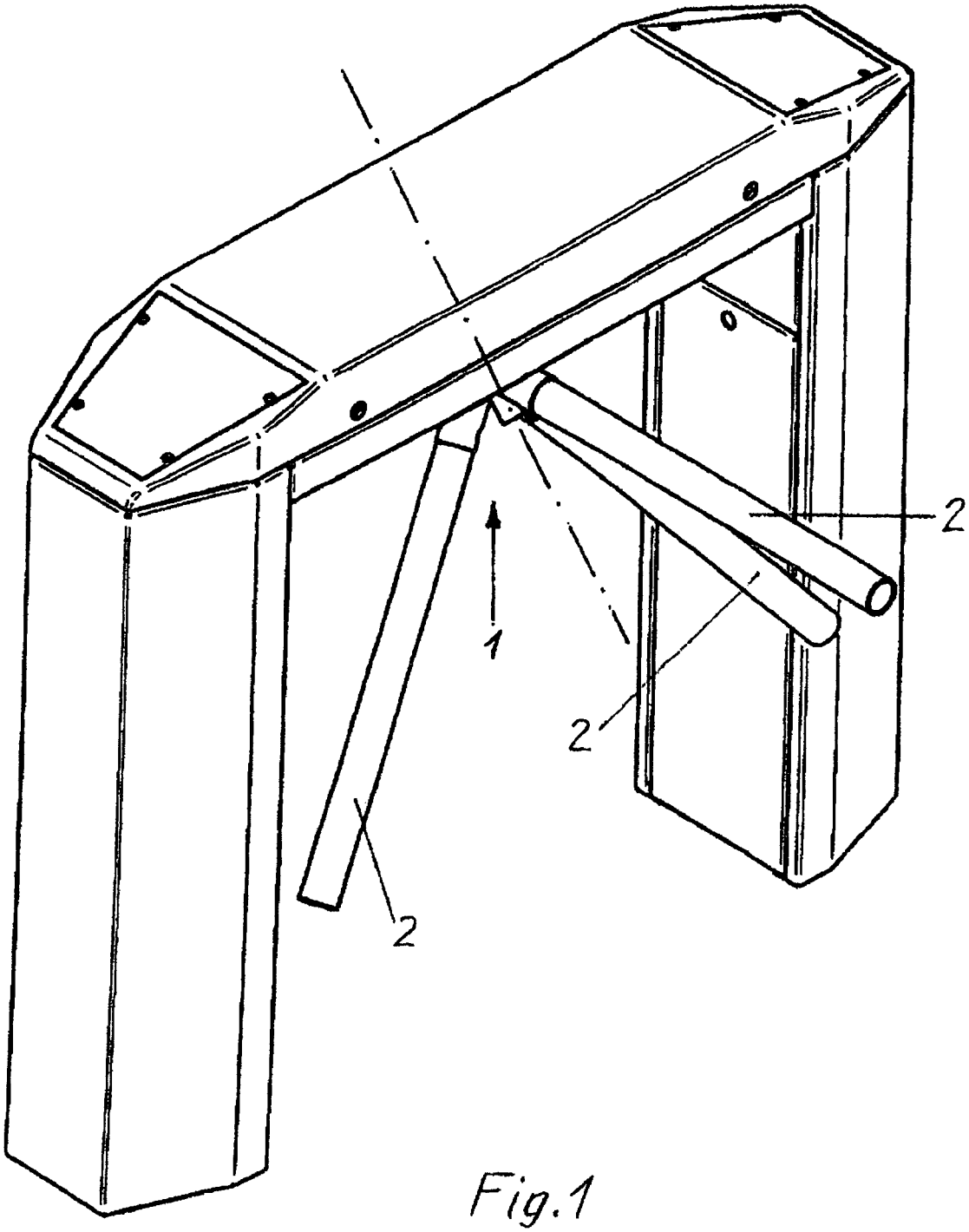

| | | | | | |
|---|---|---|---|---|---|
| 3,559,341 | A | * | 2/1971 | Alvarado | 9/47 |
| 3,978,613 | A | * | 9/1976 | Hayward et al. | 49/46 |
| 5,072,543 | A | * | 12/1991 | Tetherton | 49/47 |
| 5,471,795 | A | * | 12/1995 | Gallenschutz et al. | 49/506 |
| 5,605,015 | A | * | 2/1997 | Uhl et al. | 49/47 |
| 6,065,246 | A | * | 5/2000 | Detassis | 49/47 |
| 6,142,283 | A | * | 11/2000 | Amdahl et al. | 194/205 |
| 6,715,234 | B1 | * | 4/2004 | Libardi | 49/42 |
| 7,627,984 | B2 | * | 12/2009 | Wallerstorfer | 49/47 |
| 7,845,115 | B2 | * | 12/2010 | Ponert et al. | 49/47 |

FOREIGN PATENT DOCUMENTS

| | | |
|---|---|---|
| DE | 4445698 | 6/1996 |
| DE | 20200307 | 5/2002 |
| EP | 0658680 | 6/1995 |
| EP | 0718460 | 6/1996 |

* cited by examiner

ROTARY LOCK COMPRISING A LOCKING ARM THAT CAN BE PIVOTED PARALLEL TO THE MAIN ROTARY AXIS

The invention relates to a rotary lock for controlling the passage of persons having a blocking unit which can be rotated about a rotational axis which is inclined downward by approximately 45° with respect to the horizontal, can be locked against rotation by means of an unlockable locking mechanism, can be released for rotation in at least one rotational direction, and has at least two blocking arms which are inclined with respect to the rotational axis and of which, in the operational position of the system, in each case one unblocking arm is situated in a substantially horizontal blocking position which locks the passage and the other blocking arm or blocking arms is/are moved out of the passage region, it being possible for the blocking arms to be moved one after another from the position which locks the passage into a position which releases the passage as a result of rotation of the blocking unit which is made possible as a consequence of a command to the unlockable locking mechanism, and said blocking arms being articulated on a bearing plate of the blocking unit in such a way that the blocking arm which is situated in its blocking position in the operational state of the system can be pivoted, by triggering of an unlocking mechanism, out of its locked normal position on the bearing plate into its release position which permits the unimpeded passage of persons in the case of the system being rendered nonoperational, for example as a consequence of a power cut or of the power being switched off, and in such a way that said blocking arm can move back automatically into its locked normal position after termination of the operation which triggers the unlocking action.

Rotary locks of this type are used at turnstiles, in order to make the controlled entry or exit of persons possible. The passage is opened as a function of previously defined criteria for in each case one person by rotation of the locking apparatus by one advance switching step, the next locking element being moved behind each passing person into its position which first of all blocks the passage for a following person. However, it also has to be ensured in systems of this type that the unimpeded passage for preferably all people is possible, for instance, if a disruption occurs, for example as a consequence of a power cut, or in the case of the lock being rendered nonoperational deliberately or in a dangerous situation, in order that an escape route is kept open.

Known single-arm or double-arm locks have proven disadvantageous, in so far as they develop a high impact force and therefore the risk of injuries, especially for children, on account of the comparatively rapid rotation which they have to carry out. The triple-arm locks have therefore become established predominantly.

DE-C 28 25 787 has disclosed a turnstile system which has three blocking arms which extend trigonally from a bearing plate and, by rotation of the turnstile, pass one after another into a position which blocks the passage and a position which releases the passage. In their normal position, the blocking arms protrude from the bearing plate at a defined angle, but are connected in an articulated manner to it in such a way that the blocking arm which is situated in its normal position is unlocked in its joint, for example if a power cut occurs or if the power is switched off, and said blocking arm can pivot, as a result of the action of gravity, into a release position which makes unimpeded passage possible. In this system, the blocking arm which has been unlocked in this way, that is to say rendered nonfunctional, has to be moved manually into its normal operating position for recommencing operation. This is very laborious and time consuming and has a disadvantageous effect, in particular, in the case of relatively large premises which are to be monitored.

German utility model 69 37 378 has disclosed a similar turnstile system, in which, after a blocking arm has been folded away out of its blocking position, for example on account of a disturbance or an intentional shutdown, said blocking arm likewise has to be moved back manually into its operating position for recommencing normal operation.

DE 44 45 698 C2 and EP 0 658 680 B1 have also disclosed a similar turnstile system, in which, however, an unlocked blocking arm, which has therefore been rendered nonoperational, returns automatically into its normal operating position, in which it is held by latching means, as a result of gravity after recommencing of operation, as a result of the turnstile or the bearing plate which carries the blocking arms being rotated by at least one advance switching step. In order that the relevant blocking arm can return into its normal operating position in this way, it has to reach a certain position on the bearing plate during rotation of the turnstile. Gravity cannot develop its full effect until the zenith of the rotation has been reached or passed. For this reason, the automatic return of an unlocked blocking arm is not really ensured in the case of only one advance switching step of the turnstile. There is therefore also the express indication in the abovementioned documents that the blocking arm reaches its operating position in a particularly reliable way when the turnstile is moved on by at least two advance switching steps, that is to say when the blocking arm passes through the zenith of the rotation in the process. On account of the rapid movement when the blocking arms latch in again, this return of the unlocked blocking arm by way of one or two advance switching steps involves a certain risk of injury.

The locking elements of known locking systems are locked via lever systems and clamping elements, via hydraulic or pneumatic brakes, which is very complicated, costly and also susceptible to faults. A roller system which runs on a cam disk is required for the exact positioning of the locking elements in the blocking positions. Moreover, hydraulic and pneumatic systems are subject to stringent safety requirements. Clamping elements, cam disks and pivoting bolts cannot be unlocked under load as locking elements.

A further disadvantage of these known turnstile systems is the drive with the aid of a geared motor which, depending on the type of gearing, develops unpleasant noise and is subject to high wear. A relatively high exertion of force is required to rotate the blocking unit further. In the event of a power cut, a self-locking gear mechanism can no longer be rotated from the outside, which can have a very disadvantageous effect in the case of panic, and gear mechanisms without self-locking also require a great external actuating force in the event of a power cut, in order for it to be possible for them to be moved.

It is an object of the invention, in a rotary lock of the abovementioned type, to make the automatic return secure and reliable of a locking element which has been pivoted out of its normal position into its release position, and therefore also to ensure the return to service of the rotary lock in as undelayed a manner as possible and in a reliable and uncomplicated way after termination of a disruption of whatever nature. The apparatus should be as simple as possible in its construction, functionally reliable overall and subject to low wear.

According to the invention, this is achieved by the fact that the locking of each blocking arm on the bearing plate is produced by a locking element which acts through an opening, by the fact that, if the power is interrupted, the locking element of the blocking arm which is situated in the blocking position can be released mechanically from the engagement on the opening counter to a spring force, and, when the locking action is released, a force which acts eccentrically on this blocking arm pivots the latter in its mounting on the bearing plate, about a rotational axis which is parallel to the main rotational axis of the blocking unit, rotationally out of its normal position into its release position, and by the fact that, when the power supply is restored, the pivoted blocking arm can be arrested temporarily and, by rotation of the locking plate by less than one advance switching step of the rotary lock, this blocking arm can be moved back into its normal position as a result of its relative rotation to the bearing plate which is brought about in the process, and can be locked in said normal position again by the locking element.

A rotation of the blocking unit by only approximately half an advance switching step of the rotary lock is sufficient to restore the pivoted blocking arm; in the process, it moves in a very safe, reliable and also gentle manner without a hard impact during latching and without a risk of injury for persons.

The force which acts eccentrically on the blocking arm can be a spring force and/or gravity.

The blocking arms can be held pivotably in openings of the bearing plate via receiving journals and can be locked with respect to the bearing plate by a locking element.

The spring which acts eccentrically on the receiving journal or the blocking arm is preferably a helical spring. In contrast to a spiral spring, it is less readily susceptible as a result of the rotating movements.

The locking element can be a locking journal which protrudes through an opening of the bearing plate and is moved out of engagement in the opening counter to a spring force by an unlocking lever which can be pivoted in the event of a power cut.

An opening is preferably provided for the engagement of a locking journal on the bearing plate in the region of each blocking arm, which locking journal can be displaced radially on the blocking arm or on a receiving journal of the blocking arm counter to a spring force by an unlocking lever, which can be pivoted in the event of a power cut, and can be released from the engagement in the opening. A locking means of this type is very simple in its construction but reliable in its method of operation.

During normal operation of the rotary lock, the unlocking lever can be held securely at a spacing from the locking journal, counter to the force of an unlocking spring, by a first electric lifting magnet.

The blocking arms are held pivotably in openings of the bearing plate either directly or preferably via receiving journals; engagement means are provided on the rear side of the blocking arms or of the receiving journals, on which engagement means a spring force acts eccentrically, and the other end of which engagement means is anchored on the rear side of the bearing plate; the unlocked blocking arm can be pivoted by the spring force, for example, of a tension spring or a helical spring in the opening of the bearing plate about an axis which is parallel to the main rotational axis of the blocking unit.

According to one preferred embodiment of the invention, a plurality of protruding pins can be arranged as engagement means on the rear side of the blocking arms or of their receiving journals; a tension spring, preferably a helical spring, can act eccentrically on one of said pins, the other end of which tension spring is anchored on the rear side of the bearing plate.

According to another embodiment, a friction wheel can be arranged as engagement means on the rear side of the blocking arms or of their receiving journals.

According to a further embodiment, a toothed disk can be arranged as engagement means on the rear side of the blocking arms or of their receiving journals.

When the system is set in operation again, a locking lever is connected temporarily to the blocking arm which is pivoted out of the passage region, by a positive or nonpositive connection, for the purpose of arresting this blocking arm; a rotation of the blocking arm relative to the bearing plate is brought about by rotation of the blocking unit or the bearing plate by less than one advance switching step of the blocking unit, and the blocking arm is returned into its normal position and is locked again in the process.

The locking lever preferably has latching notches, by way of which it can be brought into a positively locking connection on pins which protrude from the rear side of the blocking arm or its receiving journal or with a toothed disk which is arranged on the rear side of the blocking arm or its receiving journal.

The latching notches preferably have a rather flat flank for a pin or a toothing system to slide into and a steep flank, with which a pin or a toothing system comes into contact during latching. As a result of the force component which acts on the steep flank predominantly in the engagement direction, the pin or the toothing system can be held in its engagement with a relatively low lever force.

When the power supply is restored, the locking lever can advantageously be actuated by a second electric lifting magnet for arresting the blocking arm which is pivoted out of the passage region.

A brushless DC motor without gear mechanism and with direct drive is preferred as drive motor for the blocking unit.

It is subjected to less wear than a geared motor.

Moreover, the blocking unit can be secured against impermissible rotation by an electromagnetic brake which acts directly on the drive shaft of the blocking unit. It represents an overload safeguard and also affords protection against damage, for example as a result of vandalism.

The positional control, positional regulation and positional sensing for the blocking unit can take place via a rotary encoder which is installed directly on the rotor shaft of the drive motor. This rotary encoder can be a resolver.

Figure 2:
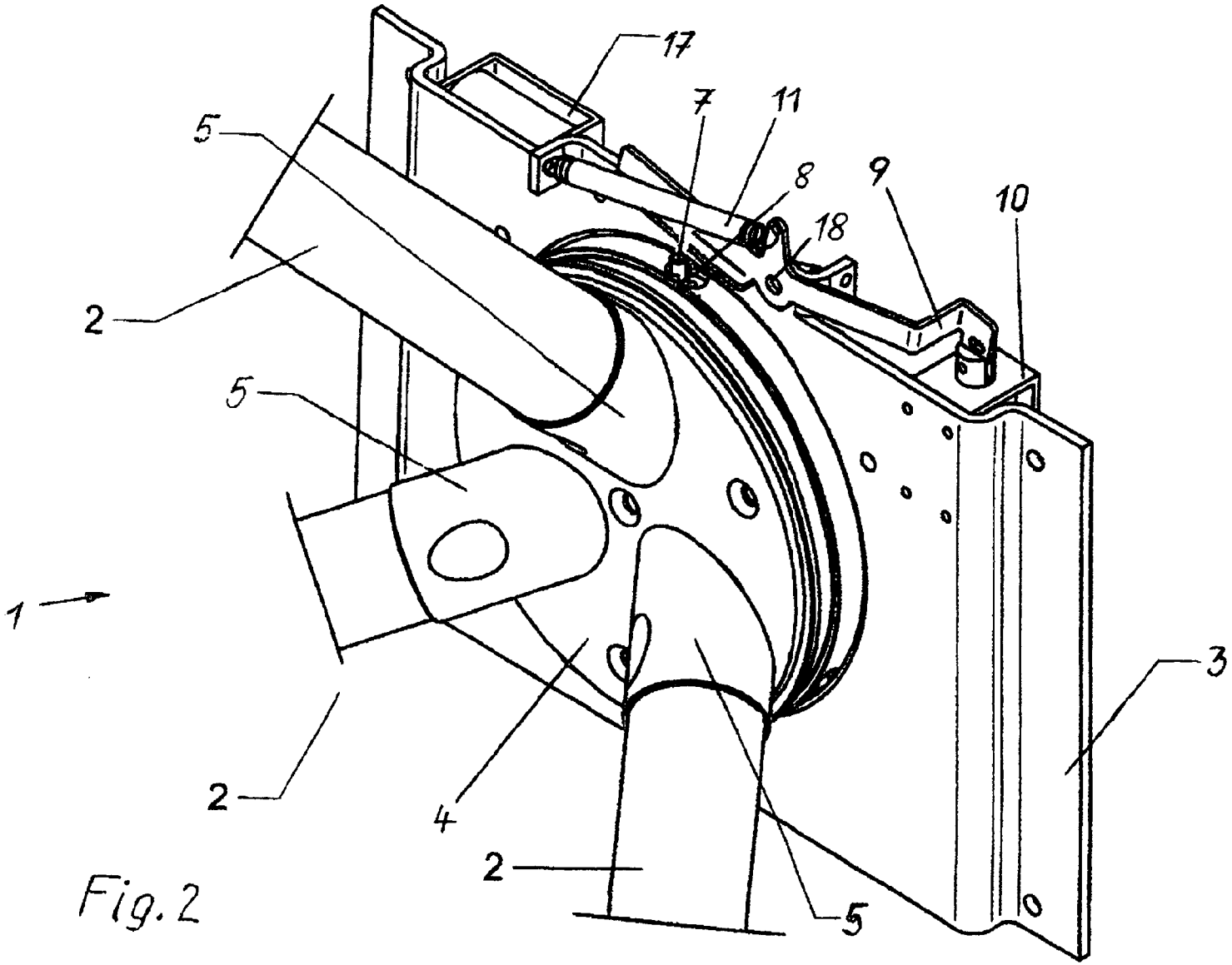
Figure 3:
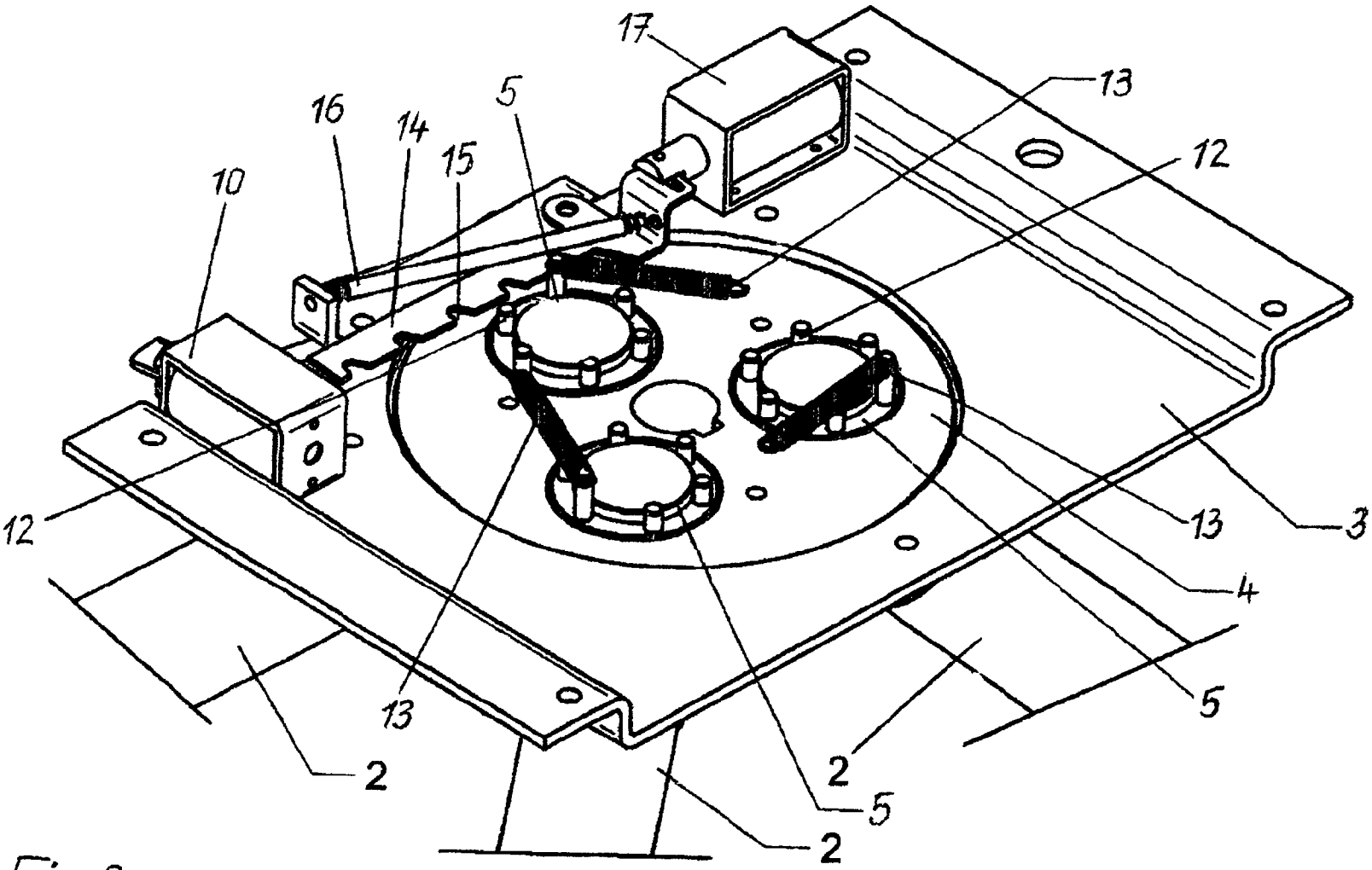
Figure 4:
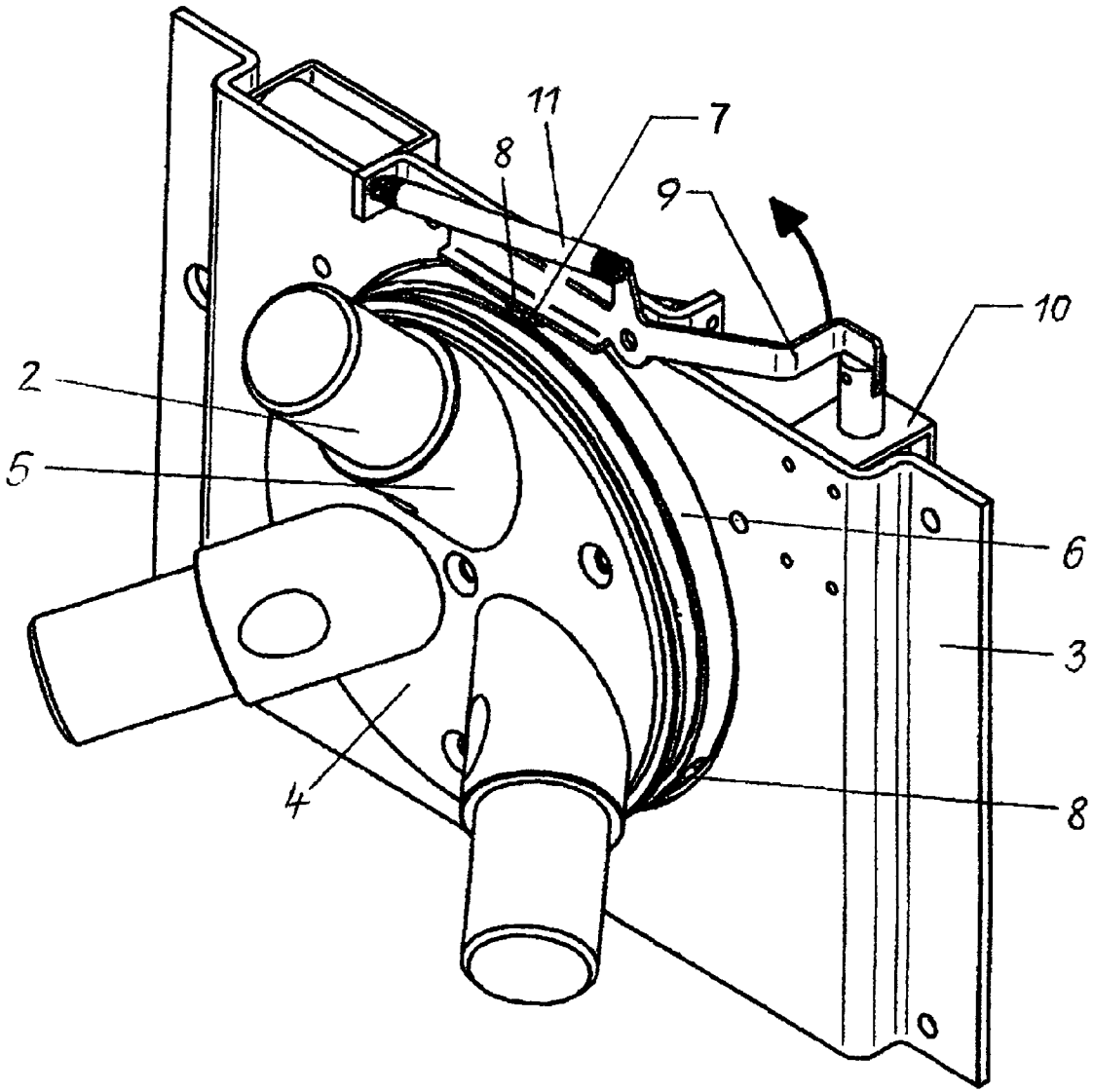
Figure 5:
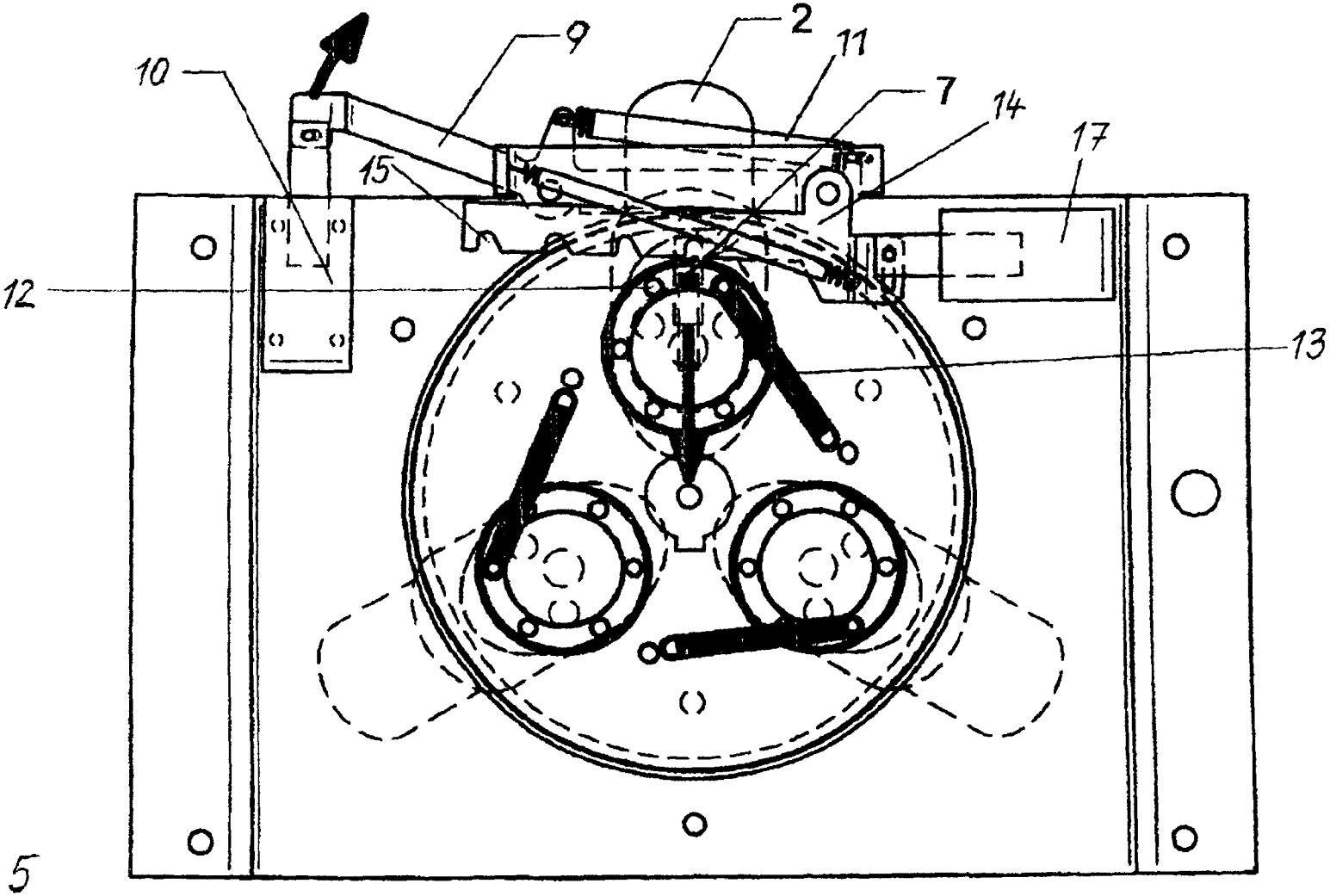
Figure 6:
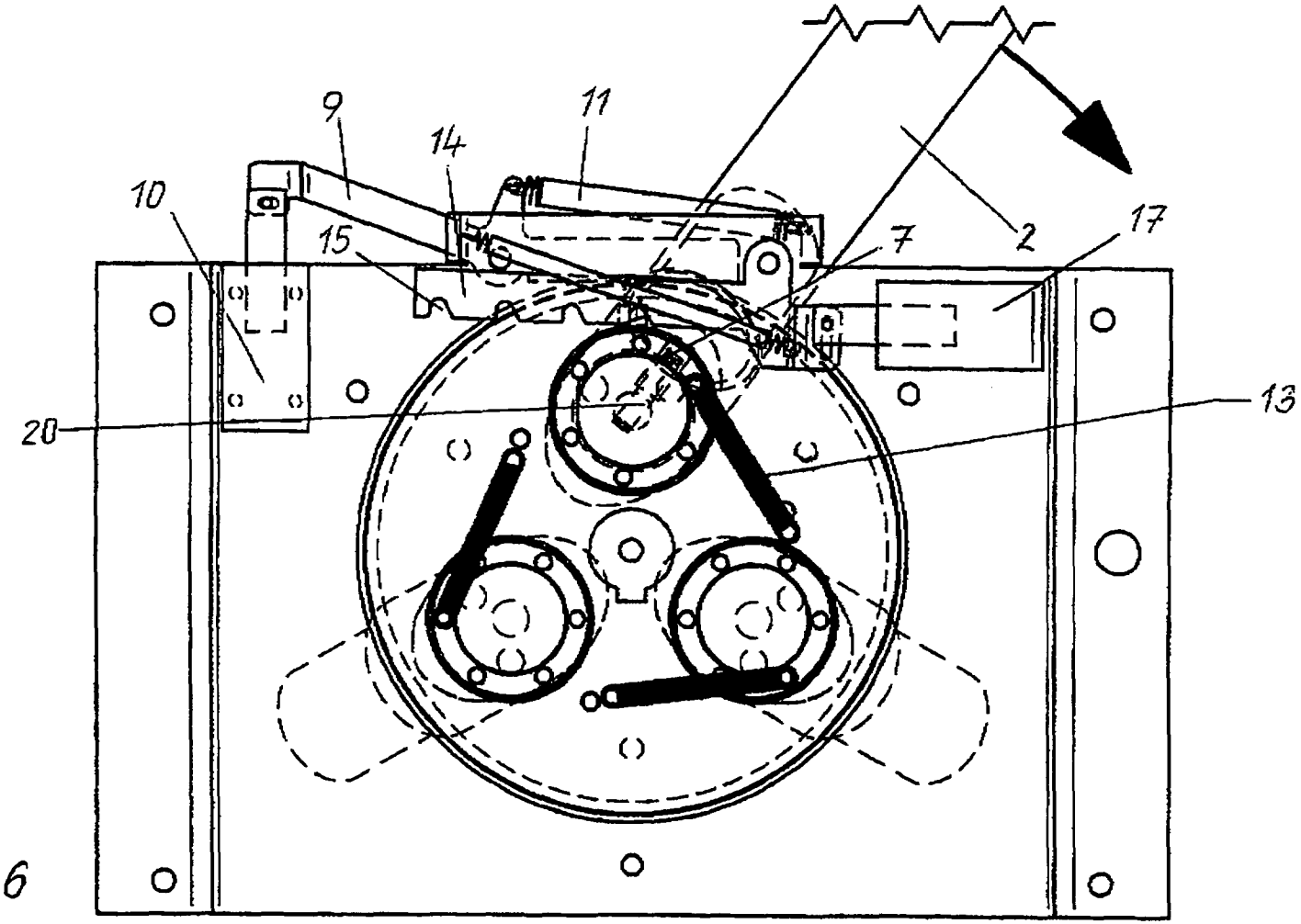
Figure 7:
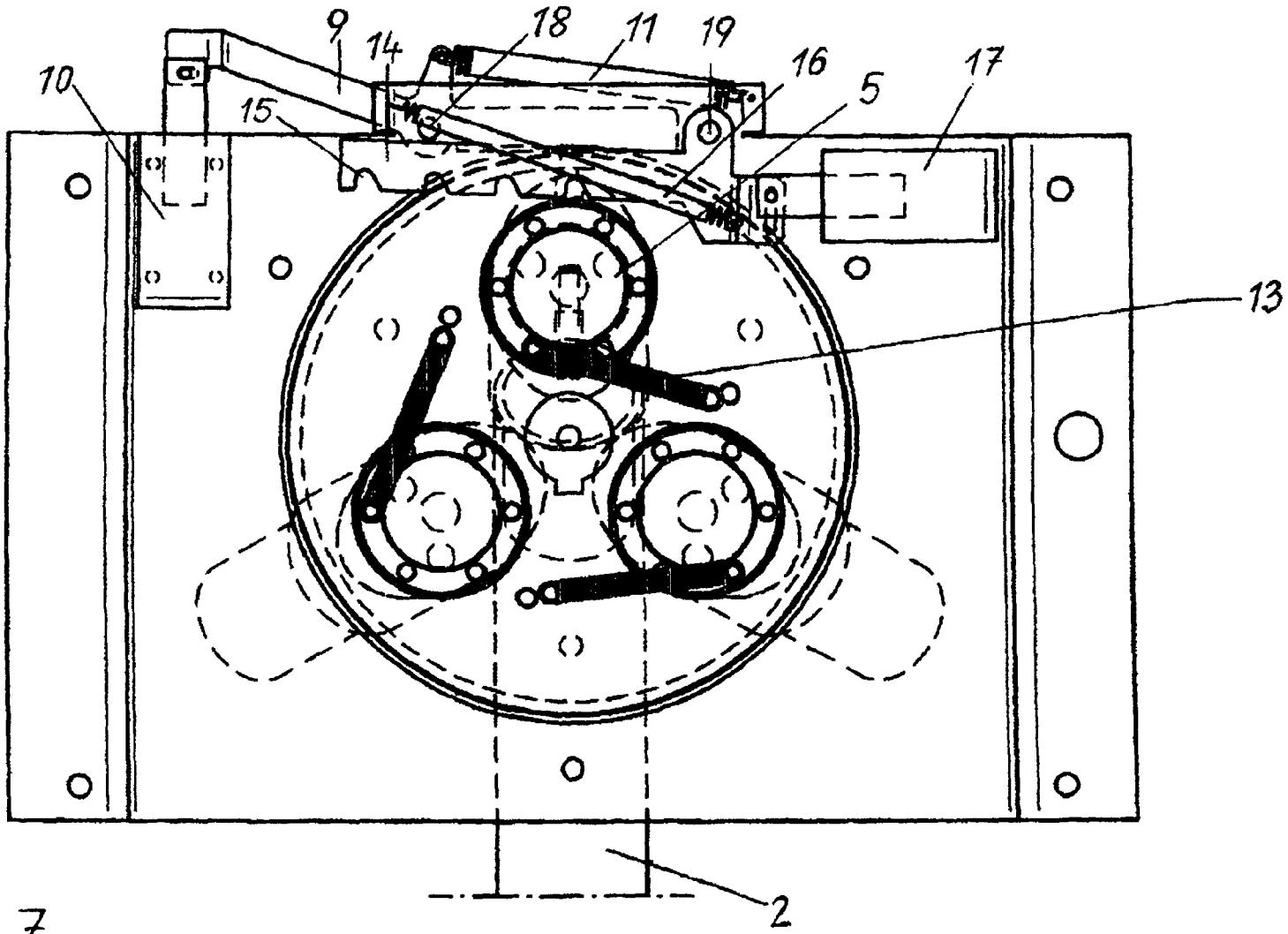
Figure 8:
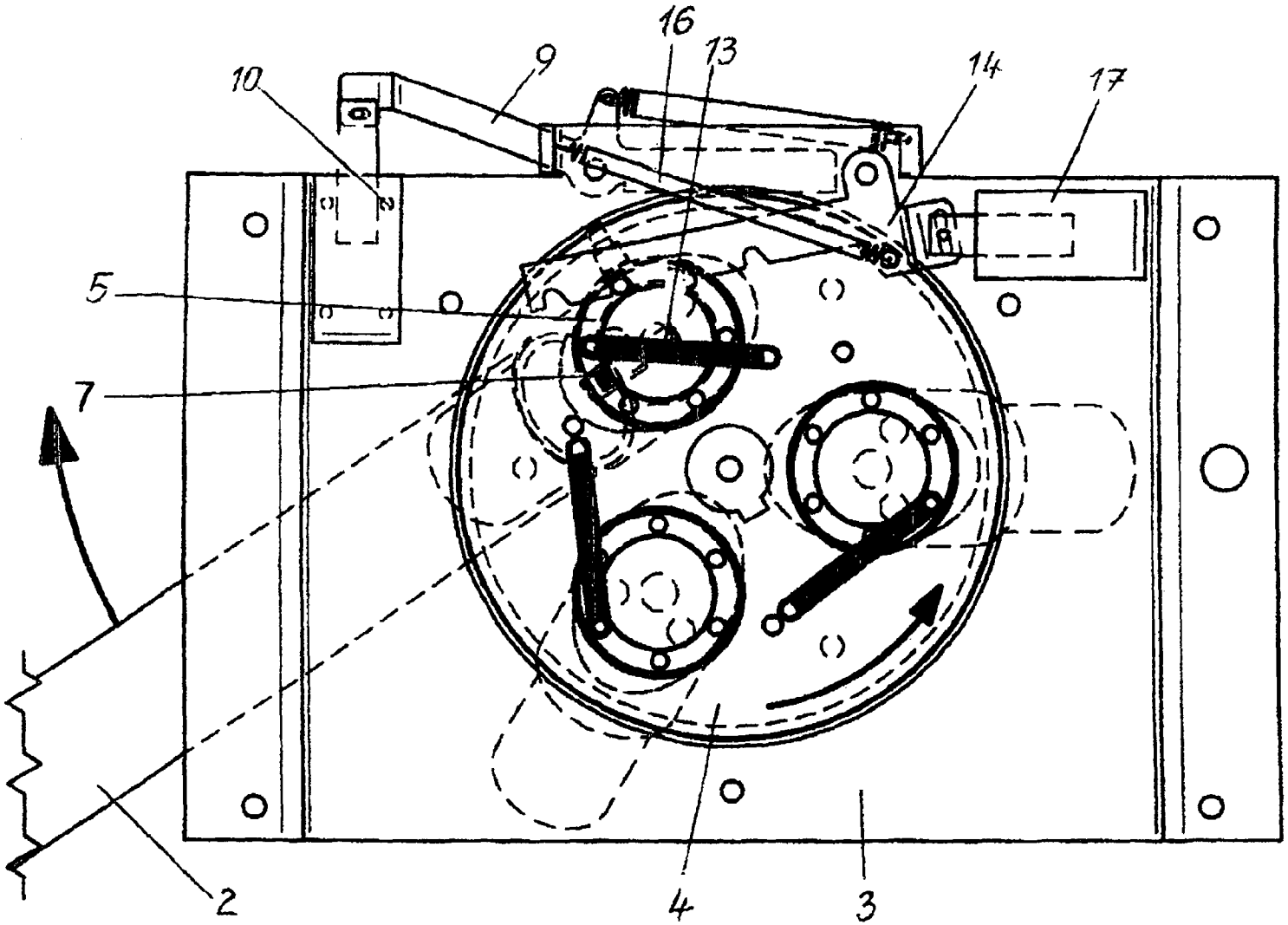
Figure 9:
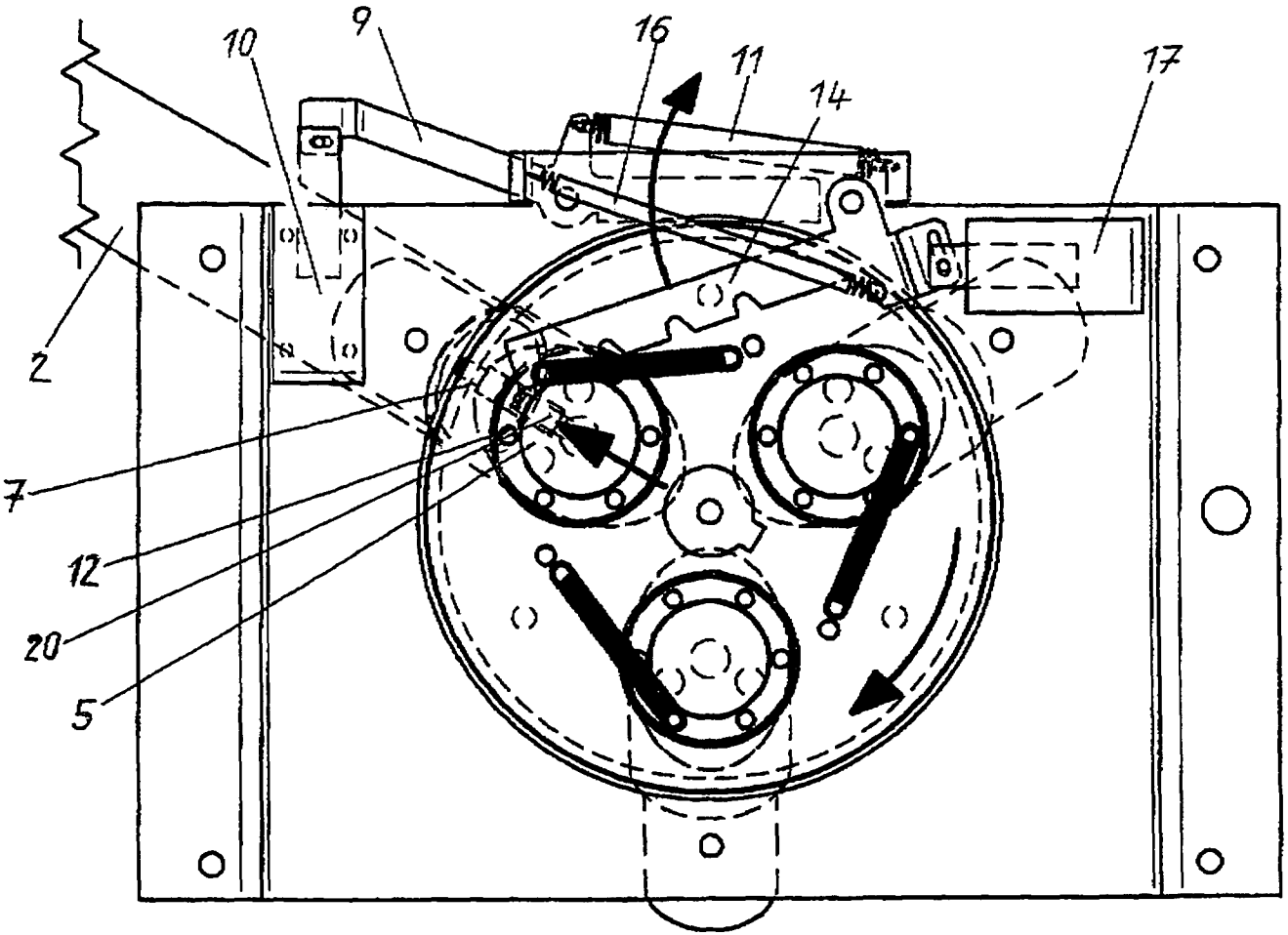

In the following text, the invention will be described in greater detail by way of example using the appended drawing, in which:

FIG. 1 shows a perspective view of a rotary lock,

FIG. 2 shows a perspective front view of the blocking unit which is used in the rotary lock according to FIG. 1, FIG. 3 shows a perspective rear view of the blocking unit in the operating state according to FIG. 2, FIG. 4 shows the view of the blocking unit according to FIG. 2 when a locking element is unlocked, FIG. 5 shows the rear view of the blocking unit when a locking element is unlocked, FIGS. 6 and 7 show the rear view of the blocking unit when a locking element is pivoted into its release position, and FIGS. 8 and 9 show the rear view of the blocking unit when the previously pivoted locking element has returned into its normal operating position.

FIG. 1 shows a triple-aim rotary lock having a blocking unit 1 which can rotate about a rotational axis which is inclined by approximately 45° with respect to the horizontal, from which blocking unit 1 three locking elements 2 (in the form of blocking arms 2 here) extend at an angle of in each case 120° with respect to one another. According to FIG. 2, the blocking unit 1 is mounted on a carrier plate 3. The blocking arms 2 extend at in each case the same angle from a bearing plate 4, on which they are held with their one end in receiving journals 5 which are mounted in openings of the bearing plate 4 such that they can be pivoted away. A collar 6 can be formed on the circumference of the bearing plate 4, via which collar 6 the bearing plate 4 is mounted rotatably in a circular opening of the carrier plate 3. In each case one locking journal 7 which is loaded radially to the outside by a spring 20 but can be displaced radially counter to the force of the spring 20 and, in the normal position, protrudes through a corresponding opening 8, preferably a hole, in the bearing plate 4 is provided on each receiving journal 5 (see below and FIG. 5 in this regard). In this normal position of the locking journal 7 which is shown in FIG. 2, it holds the associated blocking arm 2, via its receiving journal 5, in its normal angular position which is also the normal operating position of the rotary lock. The locking journal 7 which is currently situated at the vertex of the rotatable bearing plate 4 can be actuated counter to the spring 20 force which loads it by an unlocking lever 9 which is held in the normal position, that is to say at a spacing from the locking journal 7, by a first electric lifting magnet 10 counter to the force of an unlocking spring 11.

According to FIG. 3, pins 12 protrude as engagement means from the rear side of the receiving journals 5. In each case one tension spring 13 which is preferably a helical spring and is anchored on the bearing plate 4 by way of its other end acts on one of the pins 12 of each receiving journal 5. Moreover, a locking lever 14 is arranged pivotably on the rear side of the carrier plate 3, which locking lever 14 can come into engagement by way of latching notches 15 which are formed on its longer lever arm with individual pins 12 of the receiving journal 5 which is situated in the uppermost position, but is kept out of engagement by a spring 16 in the normal operating state of the rotary lock. The other, shorter arm of the locking lever 14 is operatively connected to a second electric lifting magnet 17 which is normally currentless. The latching notches 15 advantageously have a rather flat flank and a steep flank. The flat flank permits a pin 12 to slide in without problems, which pin 12 then comes into contact with the steep flank and can thus be held in engagement with a relatively small lever force on account of the relatively great force component which results in the engagement direction.

Instead of the pins 12, a friction wheel or a toothed disk can be provided as engagement means on the rear side of the receiving journals 5 (or directly of the blocking arms 2).

In normal operation of the rotary lock, in each case one of the three blocking arms 2 protrudes horizontally into a passage for persons, while the two other blocking arms 2 are pivoted out of the passage into positions which point obliquely downward, as shown in FIG. 1. If a person enters the rotary lock and wishes to pass, the blocking arm 2 which protrudes horizontally, that is to say in the blocking position, is moved out of its blocking position after triggering of an actuating signal by the bearing plate 4 being rotated by a drive motor (not shown) by an advance switching step, that is to say by approximately 120°. Here, the passage is opened for this one person, while at the same time the blocking arm 2 which follows in the rotational direction moves into its horizontal and therefore blocking position, that is to say the passage for a following person is first of all blocked again and can only be opened again after a further actuating signal. The blocking unit or the bearing plate 4 is secured by an electromagnetic brake against unauthorized rotation. Said electromagnetic brake preferably acts directly on the output shaft of the drive motor or the drive shaft of the bearing plate 4. This relatively low torque therefore achieves an effective overload safeguard and also protection, for example, against damage as a result of vandalism. The drive motor is preferably a brushless DC motor without gear mechanism, that is to say with direct drive and high output torque.

In the case of an operational disruption, for example a power cut or an intentional switching off, it has to be ensured that the blocking arm 2 which is currently situated in the blocking position is moved out of its horizontal, blocking position, that is to say out of the passage region, and the unimpeded passage for all persons is opened, for example also as an escape route.

If the power is interrupted, the first electric lifting magnet 10 becomes currentless in the rotary lock which is described here; it therefore releases the unlocking lever 9, whereupon the latter is pivoted about its rotational axis 18 by the force of the unlocking spring 11 and actuates the locking journal 7 of the blocking arm 2 which is situated in the blocking position (see FIG. 4) in such a way that it is moved radially to the inside and out of its engagement in the opening 8 of the bearing plate 4, counter to the force of a spring which loads it, and the locking action of the relevant receiving journal 5 and therefore of the blocking arm 2 is released. As a result of the tension spring 13 which preferably acts eccentrically on one of its pins 12, this receiving journal 5, together with the associated blocking arm 2 which is initially still situated in the blocking position, is pivoted about an axis which is parallel to the main rotational axis of the blocking unit 1, and in the process is moved automatically out of the passage region (see FIGS. 5 and 6), with the result that the rotary lock can be passed in an unimpeded manner. Together with its receiving journal 5, the blocking arm 2 falls into a perpendicularly downwardly pointing position (see FIG. 7) as a result of gravity, the pin 12 of the receiving journal 5, on which the tension spring 13 acts, passing as far as beyond the zenith during the rotation, and the tension spring 13 being stressed again. The tension spring 13 is preferably a helical spring 13, in contrast to, for example, a spiral spring, it is not destroyed by the rotations and, when it passes the zenith, also advantageously produces a certain braking action or damping action.

When the stress is restored or following a control command, the unlocking lever 9 is pivoted back into its normal operating position by the electric lifting magnet 10. The second electric lifting magnet 17 is now likewise supplied with current, it attracts that lever arm of the blocking lever 14 which is operatively connected to it and in the process pivots the blocking lever 14 about its axis 19, until said blocking lever 14 comes into engagement by way of at least one of its latching notches 15 with one of the pins 12 on the rear side of the receiving journal 5 or otherwise a positive or nonpositive connection is produced with the receiving journal 5 or the blocking arm 2 (see FIG. 8). If the entire blocking unit 1 is then rotated by the drive motor (not shown) of the rotary lock by approximately half an advance switching step, the blocking arm 2 which is pivoted out and held fixedly by the blocking lever 14 rotates positively relative to the blocking unit 1 or to the bearing plate 4, until it passes into its operating position and its locking journal 7 engages again into its engagement point on the bearing plate 4 as a result of spring force and again locks the blocking arm 2 in this position (see FIG. 9). After the blocking arm 2 has been locked, the current to the second electric lifting magnet 17 is switched off and the spring 16 which acts on the blocking lever 14 moves the latter back into its initial position. This can be assisted by the rotary lock being set back again by half an advance switching step, with the result that the pin 12 which is latched into a latching notch 15 is released from its steep flank (see above).

Since the blocking unit 1 has to be rotated only by half an advance switching step, in order to move the blocking arm 2 which is pivoted out back into its operating position, as described, this takes place in a particularly safe and reliable way and without the risk of injury for persons.

LIST OF DESIGNATIONS

1 Blocking unit
2 Blocking arms
3 Carrier plate
4 Bearing plate
5 Receiving journal
6 Collar
7 Locking journal, locking element
8 Opening
9 Unlocking lever
10 First electric lifting magnet
11 Unlocking spring
12 Pins
13 Tension spring, helical spring
14 Locking lever
15 Latching notches
16 Spring
17 Second electric lifting magnet
18 Rotational axis
19 Axis

The invention claimed is:

1. A rotary lock for controlling a passage of persons comprising a blocking unit (1), which can be rotated about a main rotational axis, which is inclined downwardly by approximately 45° with respect to a horizontal line, which can be locked against rotation by means of a lockable mechanism, which can be released for rotation in at least one rotational direction;

a bearing plate (4) attached to the blocking unit (1);

a first blocking arm (2) lockable on the bearing plate (4) and which first blocking arm (2) is inclined with respect to a rotational axis;

a second blocking arm (2) lockable on the bearing plate (4) and wherein the second blocking arm (2) is inclined with respect to a rotational axis; and wherein, in an operational position of the rotary lock, the first blocking arm (2) is situated in a substantially horizontal blocking position which blocks the passage and the second blocking arm (2) is moved out of a passage region, wherein the first blocking arm (2) and the second blocking arm (2) can be moved one after another from a position which blocks the passage into a position, which unblocks the passage as a result of rotation of the blocking unit (1) which is made possible as a consequence of a command to the lockable mechanism, and the first blocking arm (2) being articulated on the bearing plate (4) of the blocking unit (1) in such a way that the first blocking arm (2) is situated in the blocking position in an operational state of the rotary lock and can be pivoted, by triggering a locking mechanism, a first locking element (7) associated with the first blocking arm (2) and producing a blocking of the passage by the first blocking arm (2) on the bearing plate (4);

a second locking element (7) associated with the second blocking arm (2) and producing a locking of the second blocking arm (2) on the bearing plate (4);

a collar (6) surrounding the bearing plate (4);

a first opening (8) disposed on the collar (6), wherein the first locking element (7) acts through the first opening (8);

a second opening (8) disposed on the collar (6) wherein the second locking element (7) acts through the second opening (8);

wherein upon an interruption of power, the first locking element (7) of the first blocking arm (2) which is situated in the blocking position can be released mechanically from engagement with the first opening (8) counter to a spring force, wherein a force which acts eccentrically on the first blocking arm (2) pivots, by triggering the locking mechanism, the first blocking arm (2) in its mounting on the bearing plate (4), about a rotational axis which is parallel to the main rotational axis of the blocking unit (1), out of the blocking position of the first blocking arm (2) rotationally into a release position of the first blocking arm (2), which permits the passage of persons in the case of the rotary lock being rendered non-operational and wherein, when the power supply is restored, the first blocking arm (2) can be arrested temporarily and, by rotation of the bearing plate (4) by less than one advance switching step of the rotary lock, the first blocking arm (2) can be moved back from the release position into the blocking position of the first blocking arm (2) as a result of a relative rotation of the first blocking arm (2) with respect to the bearing plate (4); and wherein the first blocking arm (2) can be locked in said blocking position again by the first locking element (7).

2. A rotary lock for controlling a passage of persons comprising a blocking unit (1), which can be rotated about a main rotational axis, which is inclined downwardly by approximately 45° with respect to a horizontal line, which can be locked against rotation by means of a lockable mechanism, which can be released for rotation in at least one rotational direction;

a bearing plate (4) attached to the blocking unit (1);

a first blocking arm (2) lockable on the bearing plate (4) and which the first blocking arm (2) is inclined with respect to a rotational axis;

a second blocking arm (2) lockable on the bearing plate (4) and wherein the second blocking arm (2) is inclined with respect to a rotational axis; and wherein, in an operational position of the rotary lock, the first blocking arm (2) is situated in a substantially horizontal blocking position which blocks the passage and the second blocking arm (2) is moved out of a passage region, wherein the first blocking arm (2) and the second blocking arm (2) can be moved one after another from a position which blocks the passage into a position, which unblocks the passage as a result of rotation of the blocking unit (1) which is made possible as a consequence of a command to the lockable mechanism, and the first blocking arm (2) being articulated on the bearing plate (4) of the blocking unit (1) in such a way that the first blocking arm (2) is situated in the blocking position in an operational state of the rotary lock and can be pivoted, by triggering a locking mechanism, a first locking element (7) associated with the first blocking arm (2) and producing a blocking of the passage by the first blocking arm (2) on the bearing plate (4);

a second locking element (7) associated with the second blocking arm (2) and producing a locking of the second blocking arm (2) on the bearing plate (4);

a collar (6) surrounding the bearing plate (4);

a first opening (8) disposed on the collar (6), wherein the first locking element (7) acts through the first opening (8);

a second opening (8) disposed on the collar (6) wherein the second locking element (7) acts through the second opening (8);

wherein upon an interruption of power, the first locking element (7) of the first blocking arm (2) which is situated in the blocking position can be released mechanically from engagement with the opening (8) counter to a spring force, wherein a force which acts eccentrically on the first blocking arm (2) pivots, by triggering the locking mechanism, the first blocking arm (2) in its mounting on the bearing plate (4), about a rotational axis which is parallel to the main rotational axis of the blocking unit (1), out of the blocking position of the first blocking arm (2) rotationally into a release position of the first blocking arm (2), which permits the passage of persons in the case of the rotary lock being rendered non-operational and wherein, when the power supply is restored, the first blocking arm (2) can be arrested temporarily and, by rotation of the bearing plate (4) by less than one advance switching step of the rotary lock, the first blocking arm (2) can be moved back from the release position into the blocking position of the first blocking arm (2) as a result of a relative rotation of the first blocking arm (2) with respect to the bearing plate (4); and wherein the first blocking arm (2) can be locked in said standard blocking position again by the locking element (7).

3. The rotary lock as claimed in claim 2, wherein the force which acts eccentrically on the first blocking arm (2) being in a blocking position is a spring force (13).

4. The rotary lock as claimed in claim 2, wherein the force which acts eccentrically on the first blocking arm (2) being in a blocking position is gravity.

5. The rotary lock as claimed in claim 2, wherein the first blocking arm (2) and the second blocking arm (2) are held pivotably in openings of the bearing plate (4) via receiving journals (5) and are locked with respect to the bearing plate (4) by the first locking element (7) or, respectively, the second locking element (7).

6. The rotary lock as claimed in claim 2, wherein the first locking element (7) protrudes through the opening (8) of the bearing plate (4) and can be moved out of engagement in the opening (8) counter to a spring force by an unlocking lever (9) which can be pivoted in the case of a power cut.

7. The rotary lock as claimed in claim 6, wherein, during normal operation of the rotary lock, the unlocking lever (9) is held and spaced from the first or second locking element (7), counter to the force of an unlocking spring (11), by a first electric lifting magnet (10).

8. The rotary lock as claimed in claim 2, wherein the first opening (8) is provided for engagement of the first locking element (7) on the bearing plate (4) in the region of the first blocking arm (2), which the first locking element (7) can be displaced radially on the first blocking arm (2) or on a receiving journal (5) of the first blocking arm (2) counter to a spring force by an unlocking lever (9), which can be pivoted in the event of a power cut, and can be released from engagement with the first opening (8).

9. The rotary lock as claimed in claim 2, wherein the first blocking arm (2) is held pivotably in an opening of the bearing plate (4) directly or via receiving journals (5), and engagement means are provided on a rear side of the first blocking arm and the second blocking arm (2) or of the receiving journals (5), wherein the force acts eccentrically on said engagement means, and an end of the engagement means is anchored on a rear side of the bearing plate (4), and wherein the first blocking arm (2) can be pivoted by the force in the opening of the bearing plate (4) about an axis which is parallel to the main rotational axis of the blocking unit (1).

10. The rotary lock as claimed in claim 9, wherein a plurality of protruding pins (12) are arranged as engagement means on the rear side of the blocking arms (2) or on their receiving journals (5), and a tension spring (13) acts eccentrically on one of said pins (12), wherein an end of said tension spring (13) is anchored on the rear side of the bearing plate (4).

11. The rotary lock as claimed in claim 2, wherein, when the rotary lock is set in operation, a locking lever (14) can be connected temporarily to the first blocking arm (2) which is pivoted out of the passage region, by a locking connection, for the purpose of arresting the first blocking arm (2), and said first blocking arm (2) can be returned into a blocking position and can be locked again as a result of a rotation of the first blocking arm (2) relative to the bearing plate (4) which is brought about by rotation of the bearing plate (4) by less than one advance switching step of the blocking unit (1).

12. The rotary lock as claimed in claim 11, wherein the locking lever (14) has latching notches (15), wherein the locking lever (14) can be brought with the latching notches into a locking connection with pins (12) which protrude from a rear side of one of the first blocking arm (2) or the second blocking arm (2).

13. The rotary lock as claimed in claim 11, wherein, when the power supply is restored, the locking lever (14) can be actuated by a second electric lifting magnet (17) for arresting the first blocking arm (2) or the second blocking arm (2).

14. The rotary lock as claimed in claim 2, wherein the blocking unit (1) can be driven by a drive motor which is a brushless DC motor without gear mechanism and with direct drive.

15. The rotary lock as claimed in claim 14, wherein a rotary encoder for positional control, for positional regulation and positional sensing is installed in the drive motor directly on its rotor shaft.

16. The rotary lock as claimed in claim 15, wherein the rotary encoder is a resolver.

17. The rotary lock as claimed in claim 2, wherein the blocking unit (1) can be driven by a drive motor via a drive shaft and is secured against impermissible rotation by an electromagnetic brake which acts directly on said drive shaft.

* * * * *